United States Patent [19]

Dompas

[11] 3,937,274

[45] Feb. 10, 1976

[54] BELT BACK-UP APPARATUS AND COOLANT APPLICATION MEANS FOR TWIN-BELT CASTING MACHINES

[75] Inventor: John M. A. Dompas, Olen, Belgium

[73] Assignee: Hazelett Strip-Casting Corporation, Winooski, Vt.

[22] Filed: May 15, 1974

[21] Appl. No.: 470,214

[52] U.S. Cl. ..... 164/278; 164/87; 164/283 MT

[51] Int. Cl.[2] ..... B22D 11/06

[58] Field of Search..... 164/87, 278, 283 MT

[56] References Cited

UNITED STATES PATENTS

| | | | |
|---|---|---|---|
| 3,041,686 | 7/1962 | Hazelett et al. | 164/87 |
| 3,167,830 | 2/1965 | Hazelett et al. | 164/278 |
| 3,426,836 | 2/1969 | Altenpohl et al. | 164/87 X |
| 3,828,841 | 8/1974 | Hazelett et al. | 164/278 |

*Primary Examiner*—Ronald J. Shore
*Attorney, Agent, or Firm*—Parmelee, Johnson & Bollinger

[57] ABSTRACT

In twin-belt casting machines for continuously casting molten metal improved belt back-up apparatus and coolant application means are provided. The front faces of the casting belts are held firmly against the moving edge dams by wide belt-supporting elements in the form of cylindrical collars on the back-up rollers or longitudinally extending fixed guide members engaging the reverse surfaces of the belts and positioned in alignment with the respective side dams and laterally spaced apart a distance no greater than the lateral spacing of the moving side dams. Nozzles are absent from the coolant supply means in the positions where the belt-supporting elements are engaging the reverse surfaces of the casting belts. The cylindrical collars may extend inwardly somewhat beyond the inner faces of the side dams and may have peripheral grooves therein for permitting liquid coolant to travel along the reverse surface of the casting belt through said grooves, with narrow fins on the back-up rollers for engaging and supporting the reverse surface of the casting belt between said cylindrical collars. The fixed guide members extend between the casting belt and the back-up rollers and are secured by lateral braces extending between the back-up rollers and have saddles therein for receiving journal portions of the rollers fitting in said saddles.

11 Claims, 9 Drawing Figures

BELT BACK-UP APPARATUS AND COOLANT APPLICATION MEANS FOR TWIN-BELT CASTING MACHINES

DESCRIPTION

1. Field of the Invention

The present invention is in the field of continuous casting of molten metal, and in particular it relates to twin-belt casting apparatus for casting bar and slab product. The invention is in the structure of the back-up roller apparatus arranged in relation to the moving edge dams for supporting and guiding the two casting belts and in the arrangement of the coolant application means.

2. Description of the Prior Art

In prior twin-belt machines for continuously casting molten metal the casting belts were supported and guided by back-up rollers having narrow ridges or fins with relatively sharp rims engaging the reverse surfaces of the belts. These ridges enabled fast moving layers of coolant to travel along the reverse surface of the belts for withdrawing the immense amount of heat given off by the molten metal as it solidifies. For further information about such prior back-up rollers, reference may be made to U.S. Pat. No. 3,036,348, issued on May 29, 1962 to Robert William Hazelett and Richard Hazelett.

The liquid coolant, e.g., water, was applied uniformly at high velocity as explained in said patent and also in U.S. Pat. No. 3,041,686, which issued on July 3, 1962 to the same two inventors.

In casting copper bar and slab product using the back-up rolls of the prior art, as illustrated in the first two Figures of the drawings, the casting belts grew rapidly corrugated and sometimes became perforated or longitudinally slit in their areas of contact with the edges of the cast product. This corrugation and slitting of the casting belts sometimes extended into the region beneath the edges of the side dams adjacent to the cast product. This problem of corrugating of the thin, flexible steel casting belts occurred with both the upper and lower belts, but it was more severe with the lower one.

The usual maximum lifetime of the lower casting belt during continuous casting of copper bar product was about four hours using prior art practices as shown in FIGS. 1 and 2. However, when the casting machine was temporarily shut down to replace the lower belt, it was usually expedient to replace the upper one as well. Thus, in actual practice the usual maximum lifetime of four hours applied to both casting belts.

This rapid deterioration was found to be due primarily to metal splashes, often spheriodal when solidified, which were entrapped between the casting belts and the moving side dams at the input end of the casting machine. As soon as the casting belts began to be indented and corrugated in the prior art, some small amounts of molten metal apparently would creep out directly from the casting zone and solidify between the side dams and the casting belts, thus aggravating the situation and further corrugating the belts.

SUMMARY OF THE INVENTION

In twin-belt casting machines for continuously casting molten metal improved belt back-up apparatus and coolant application means are provided. The front faces of the casting belts are held firmly against the moving edge dams by wide belt-supporting elements in the form of cylindrical collars on the back-up rollers or longitudinally extending fixed guide members engaging the reverse surface of the belts and positioned in alignment with the respective side dams and laterally spaced apart a distance no greater than the lateral spacing of the moving side dams. Nozzles are absent from the coolant supply means in the positions where the belt-supporting elements are engaging the reverse surfaces of the casting belts. The cylindrical collars may extend inwardly somewhat beyond the inner faces of the side dams and may have peripheral grooves therein for permitting liquid coolant to travel along the reverse surface of the casting belt through said grooves, with narrow fins on the back-up rollers for engaging and supporting the reverse surface of the casting belt between said cylindrical collars. The fixed guide members extend between the casting belt and the back-up rollers and are secured by lateral braces extending between the back-up rollers and have saddles therein for receiving journal portions of the rollers fitting in said saddles.

DESCRIPTION OF THE DRAWINGS

FIG. 6 is an elevational view of the input end of a twin-belt continuous casting machine with fixed back-up supporting guides cooperating with the finned back-up rollers. A portion of FIG. 6 is shown in section.

Figure 1:
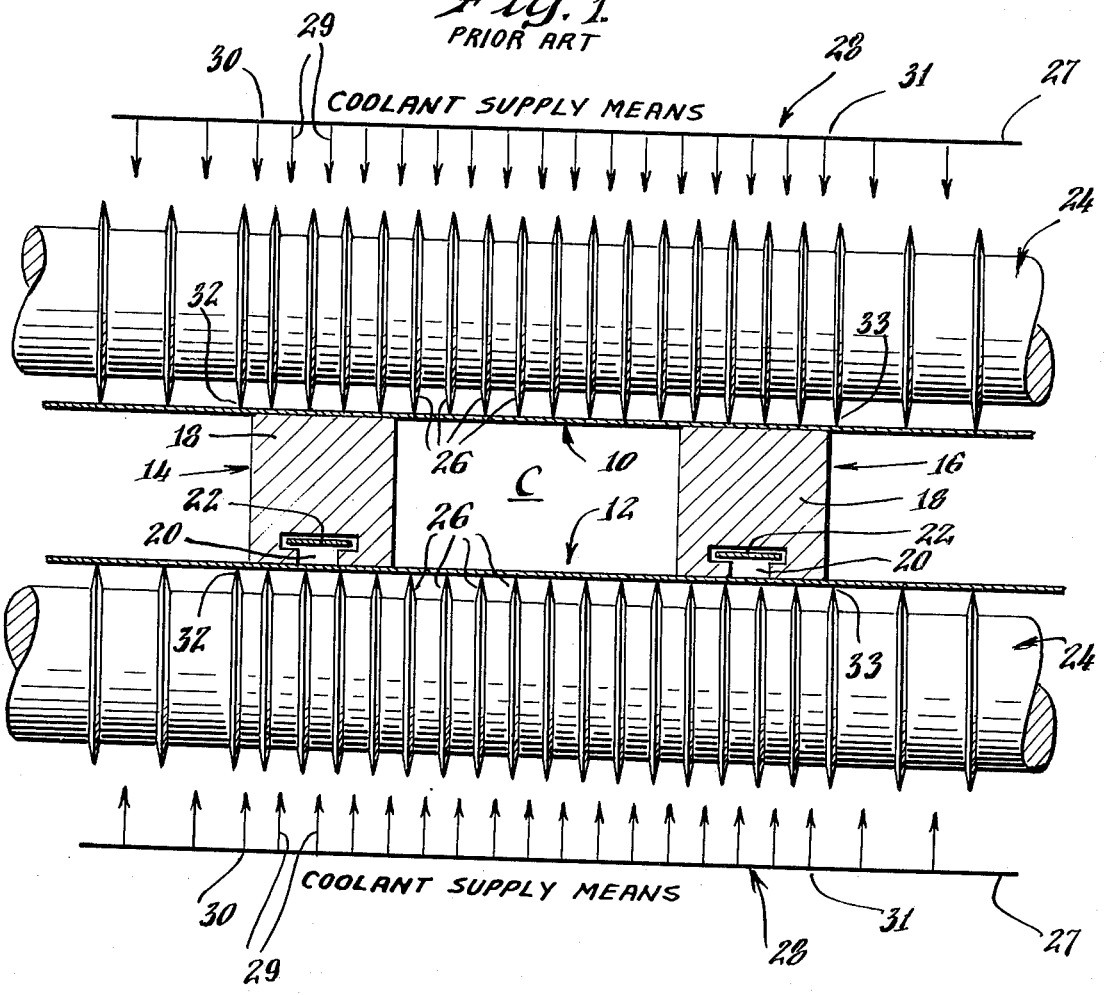
Fig. 1. PRIOR ART
FIG. 1 is a cross-sectional view through the casting zone of a twin-belt casting machine of the prior art showing the upper and lower casting belts, portions of the back-up rollers having narrow ridges on them and showing the moving side dams positioned relatively close together for casting a bar product and with coolant supply nozzles uniformly spaced across the casting zone and side dam zones.

Referring to the drawings in greater detail, in a twin-belt casting machine of the prior art, as shown in FIG. 1, when used for casting bar product, for example, copper bar, the molten metal was fed into a casting zone C defined by the front faces of the upper and lower casting belts 10 and 12. These casting belts are relatively thin flexible steel belts which revolve around large diameter rolls and which are maintained under high tension. Two such large diameter rolls 11 are 13 illustrated in FIG. 6. The casting belts travel along in spaced, parallel, opposed relationship adjacent to the casting zone C, with the front faces of the respective belts facing toward the casting zone.

There were a pair of endless moving side dams 14 and 16 which defined the two side surfaces of the casting zone in the prior art, as shown in FIG. 1. These side dams traveled between the casting belts and were carried along by the belts to confine the molten metal at its opposite sides. Thus, the edges of the cast product were formed adjacent to these side dams. Side dams 14 and 16 each comprise a plurality of dam blocks 18 having T-shaped slots 20. The dam blocks are strung onto a flexible metal strap 22 (FIGS. 1 and 2) which passed through the slot 20 in each dam block.

The casting belts 10 and 12 were supported and guided by a plurality of back-up rollers 24 each having multiple narrow ridges or fins 26 with relatively sharp rims engaging the reverse surfaces of the belts. These prior art back-up rollers are described in detail in U.S. Pat. No. 3,036,348, as mentioned above. Liquid coolant, usually water, was applied at high velocity to the reverse surfaces of both belts by coolant application means schematically illustrated at 28. The coolant application means 28 had structure similar to the coolant application means described in detail in said U.S. Pat. No. 3,036,348 or in U.S. Pat. No. 3,041,686.

The liquid coolant was applied uniformly across the width of the reverse surface of the belt in the vicinity of the casting zone C and also across the width of the belt in the vicinity of the two side dams 14 and 16. This uniform application of the liquid coolant across the width of casting zone plus side dams in the prior art is indicated by the uniformly spaced arrows 29 positioned across the full span between the points 30 and 31 for both the upper and lower belts. In some cases the coolant was applied uniformly across a greater width of the belt. The arrows 29 represent the individual coolant application nozzles. The coolant was fed to the nozzles 29 through conduits 27 extending transversely with respect to the casting belts.

The fins 26 on the back-up rollers 24 were also uniformly spaced across the full width of the casting zone plus the width of the zones where the two side dams are located. That is, the fins 26 were uniformly spaced across the full span between the points 32 and 33 (FIG. 1) for both the upper and lower casting belts.

The arrows 29 in FIG. 1 representing the coolant supply nozzles are illustrated as being aimed perpendicularly to the reverse surfaces of the belts for clarity of explanation and illustration. It is to be understood that in the actual casting machine the coolant was applied to the reverse surfaces of the belt at a slight angle of convergence and flowing longitudinally of the belt so as to provide a layer of coolant flowing at high velocity parallel to the ridges 26 and passing between the back-up rollers 24 and the belts.

Figure 2:
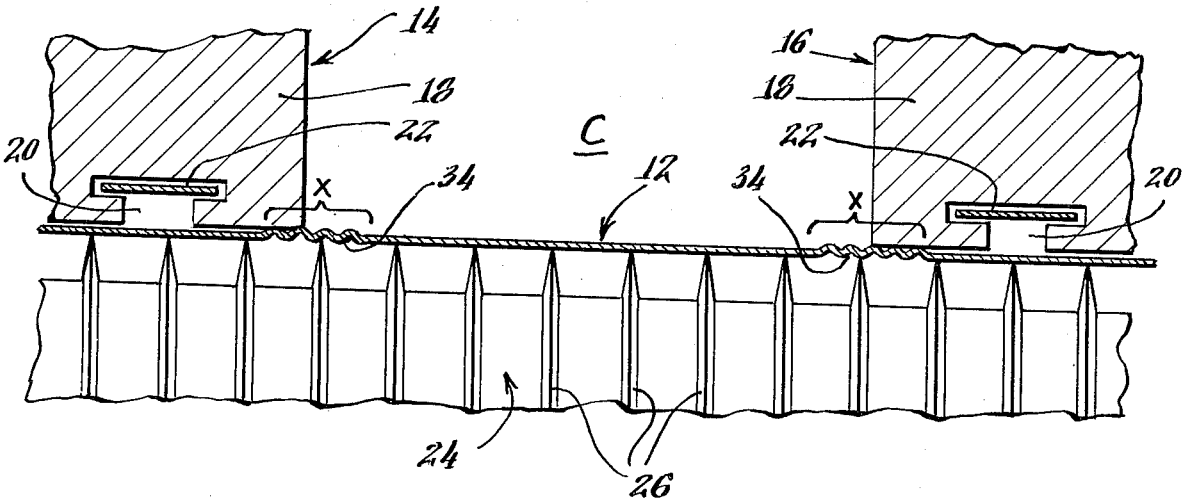
Fig. 2. PRIOR ART
FIG. 2 is an enlargement of a portion of FIG. 1 showing corrugation of the lower casting belt in a prior art machine in the area of contact with the cast product and in the regions beneath the inner edges of the side dams adjacent to the cast product.

As shown in FIG. 2 in casting metal bar and slab product, for example such as copper bar to be used for drawing into wire, the casting belts, and particularly the lower belt, grew rapidly corrugated and sometimes became perforated or longitudinally slit in the regions indicated at X. These regions X of belt damage occurred near the areas of contact with the edges of the cast product and also in the regions beneath the inner edges of the side dams 14 and 16, the inner edges being those which are adjacent to the cast product. FIG. 2 shows the corrugations 34 in the lower belt 12. As stated in the introduction, this problem of corrugating of the thin flexible steel casting belts 10 and 12 occurred with both the upper and lower belts, but it was more severe with the lower belt 12. The usual maximum lifetime of the lower belt during continuous casting of copper wire bar was about four hours, necessitating a shut down of the machine to replace the belts.

This rapid deterioration of the belts was found to be due primarily to metal splashes which often were spheroidal when solidified and which became entrapped between the front faces of the casting belts and the moving side dams 14 and 16 at the input end of the casting machine. As soon as the casting belts began to be indented and corrugated, some small amounts of molten metal apparently would creep out directly from the casting zone and solidify between the side dams and the casting belts, thus deepening the corrugations 34 much further than shown.

Figure 3:
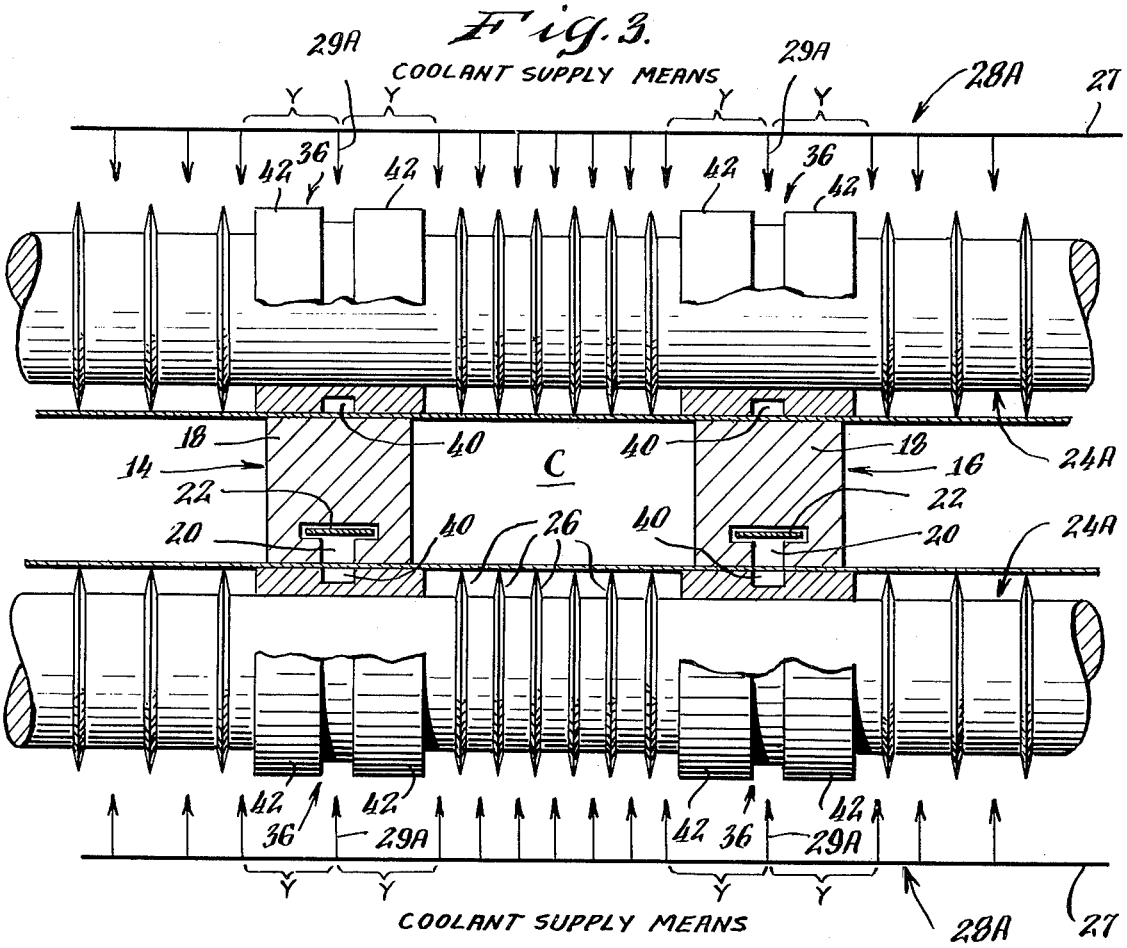
FIG. 3 is a cross-sectional view through the casting zone of a twin-belt casting machine embodying the improved back-up roller apparatus and coolant application means of the present invention.
Figure 4:
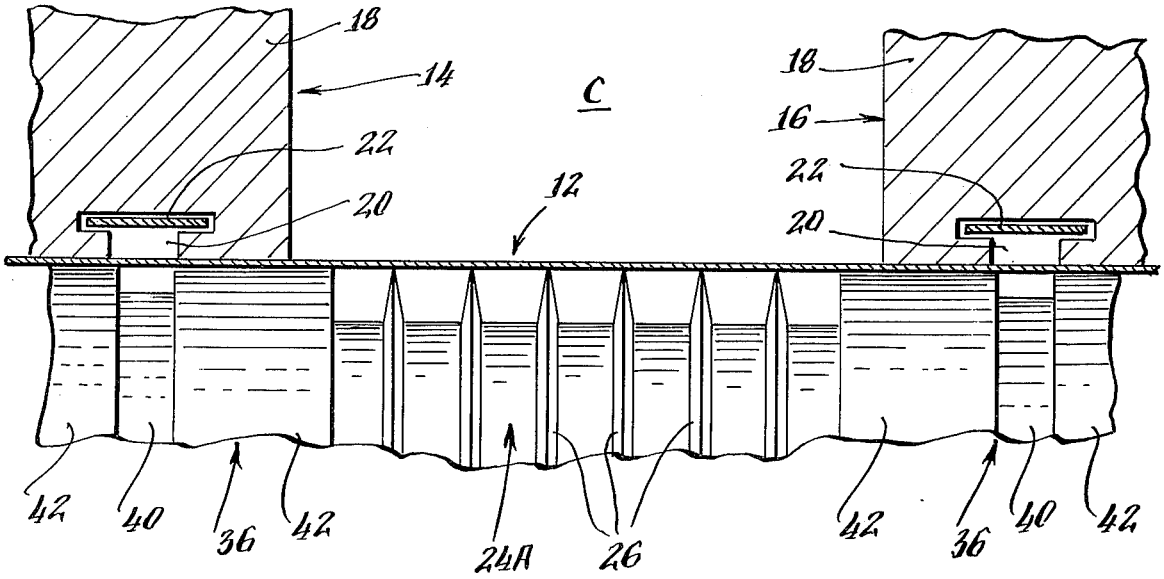
FIG. 4 is an enlargement of a portion of FIG. 3 showing the lower casting belt remaining advantageously well flat even after ten hours or more of usage in casting copper bar product, using the present invention.

In accordance with the present invention in one of its embodiments as shown in FIGS. 3 and 4 the fins 26 in the regions opposite to the side dams are replaced by a pair of cylindrical collars 36 spaced apart on the respective back-up rollers by a distance commensurate with the lateral spacing between the side dams 14 and 16. These collars 36 provide wide cylindrical belt-supporting ridges on the back-up rollers. They are positioned in alignment with the respective side dam zones, i.e. directly opposite to the respective side dams, for holding the front faces of the casting belts firmly against the damblocks of the side dams.

Figure 5:
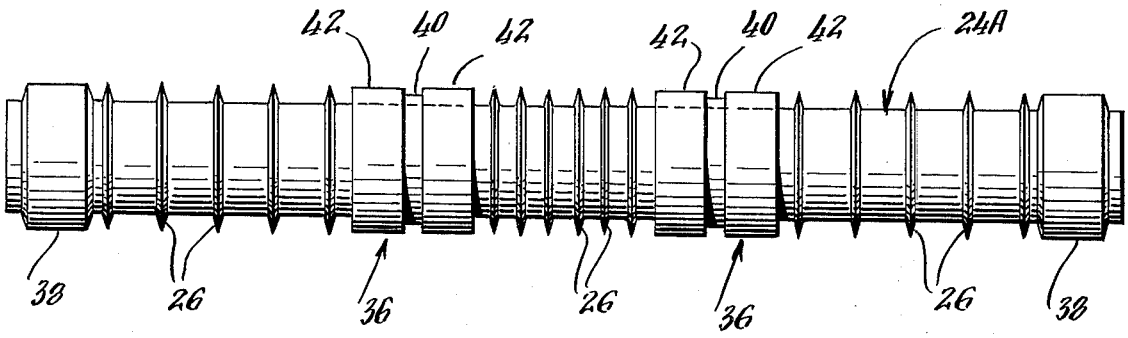
FIG. 5 is an elevational view of one of the back-up rollers embodying the present invention.

FIG. 5 shows an improved back-up roller 24A including a pair of these belt-support collars 36 axially spaced apart on the roller 24A to be in alignment with the two side dam zones. The enlarged regions 38 at each end of the roller 24A are the positions of the bearings for this roller. Preferably each of these support collars 36 has a centrally located peripheral groove 40 for permitting coolant to flow therethrough. This groove defines two cylindrical lands or belt contact regions 42 on opposite sides of the groove 40.

These collars 36 may be formed by providing hollow cylindrical members which are placed on the improved back-up rollers 24A. Alternatively, the collars 36 may be machined as an integral part of the improved back-up rollers 24A. As used herein the term "cylindrical collar" is to be interpreted broadly to include any structure for providing a wide cylindrical belt-supporting ridge on the back-up roller.

As shown in FIGS. 3 and 4 the over-all width of the cylindrical belt-supporting collars 36 may be equal to or greater than the width of the side dams 14 and 16 for providing firm support for the thin casting belts in the zones where the side dams are located and also extending beyond the inner edges of the side dams. If the axial length of these collars 36 is too small, they do not provide the desired support for the belts 10 and 12. On the other hand, if these collars 36 are too long, they unduly limit or restrict the desired coolant flow along the reverse surfaces of the belt in the casting zone.

At the edge of the casting zone C, the cylindrical collars 36 should at least extend inwardly sufficiently far to be flush with the inner faces of the side dams 14 and 16. That is, the spacing between the cylindrical collars on their roller is no greater than the spacing between the inner faces of the side dams. As used herein the term "commensurate with" is intended to mean equal to or slightly less than.

The collars 36 may extend inwardly somewhat beyond the inner faces of the side dams, as shown in FIGS. 3 and 4, to support the casting belt in that region, for example each collar may extend inwardly by an amount up to approximately 15 millimeters for a casting zone C having a width up to 120mm. For casting wider bars, in the zone C, the collars 36 may extend inwardly farther than 15 mm, if desired, but not so far as to unduly limit the desired coolant flow along the reverse surfaces of the belt near the casting zone.

As an example, in casting a bar having a width of 120mm, it has been found advantageous to have the cylindrical collars extend inwardly beyond the faces of the side dams 14 and 16 by an amount of 2.5mm on each side, providing a spacing of 115mm between the collars as contrasted with a spacing of 120mm between the side dams.

The axial length of the cylindrical collars is at least equal to the lateral width of the side dams 14 and 16, as seen in cross section in FIGS. 3 and 4, and may be somewhat greater so as to provide additional length to extend inwardly beyond the inner faces of the side dams as discussed above.

If the peripheral groove 40 has too short an axial length, it does not allow a sufficient flow of coolant to pass therethrough for providing the desired cooling effect. On the other hand, if this groove 40 has too long an axial length, there is insufficient belt-contact region 42 for providing the desired firm support. It has been found to operate to advantage to have an axial length for the groove 40 in the range from 5 millimeters to 25 millimeters.

As shown in FIG. 3, the improved coolant application means 28A, are arranged so that coolant nozzles are absent in the positions Y adjacent to and aligned with the belt contact regions 42 of the collars 36. The coolant issuing from the nozzles 29 is at a higher velocity than coolant which has already been traveling along the reverse surface of the belts. If coolant issuing from the nozzles 29 were permitted to strike directly against the lands 42 it spreads out laterally and interferes with the coolant flow traveling along the reverse surfaces of the belt. Thus, the nozzles are absent in the positions Y which are aligned with the lands 42. The nozzles may be omitted or blocked off in the absent regions Y. A pair of the nozzles 29A on the respective coolant application means 28A are positioned to aim the streams of coolant issuing therefrom directly into the grooves 40 of the respective rollers 24A for providing effective cooling of the belt in the side dam zones for both belts.

If it is desired to cast a wider bar, the side dams 14 and 16 are spaced farther apart, and vice versa. The back-up rollers 24A are then removed and replaced with rollers having the collars 36 relocated thereon so as to be aligned with the relocated side dams. Also, the arrangement of the coolant application nozzles 29 and 29A is changed to align the nozzles 29A with the grooves 40 and to provide absent regions Y aligned with the lands 42 on the respective collars 36.

With the apparatus as shown in FIGS. 3, 4, and 5 the life of the casting belts 10 and 12, and particularly of the lower belt 12 is extended from approximately four hours to approximately ten hours or more when casting copper bar.

Figure 6:
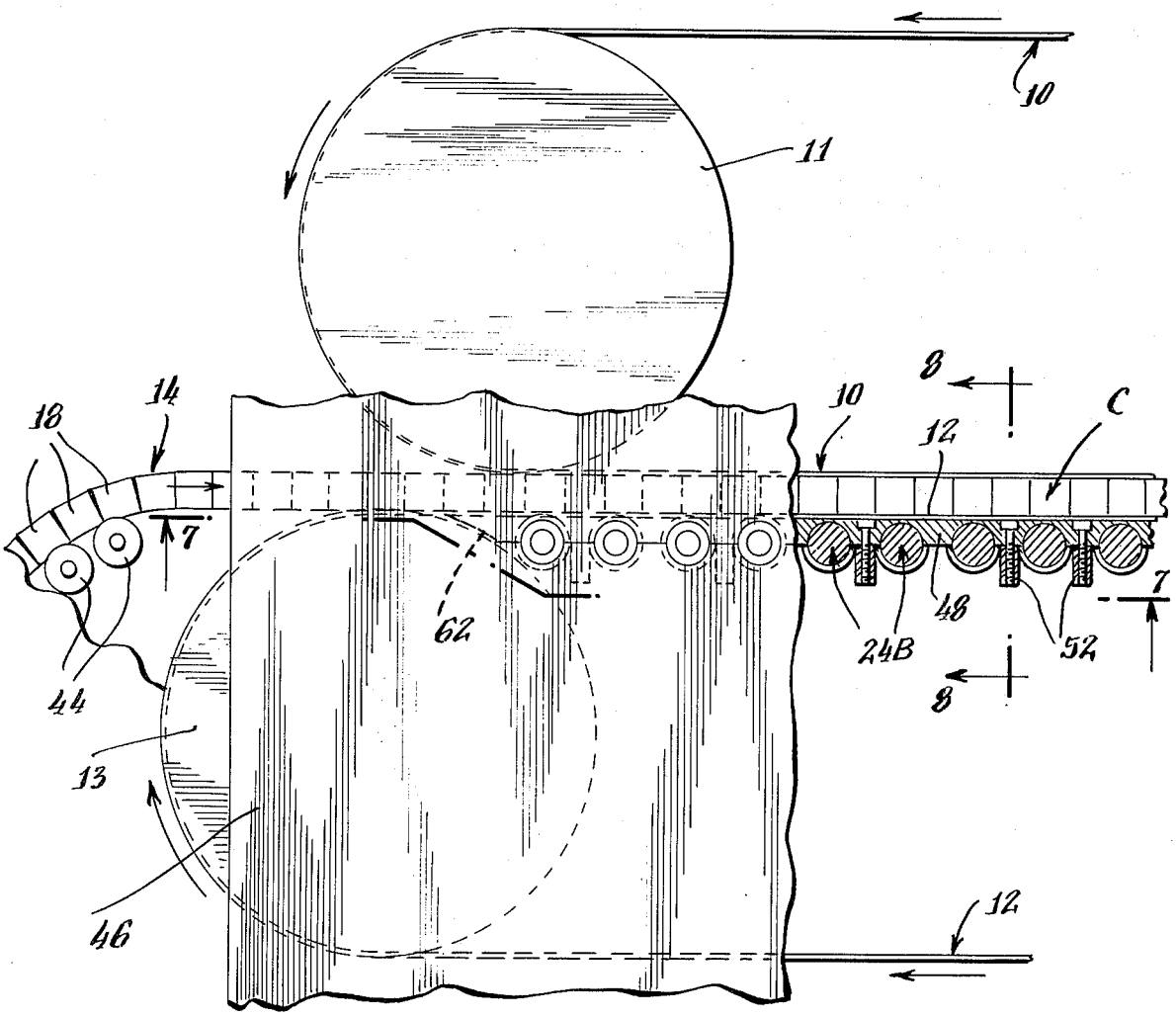
FIG. 6 illustrates another embodiment of this invention.
Figure 7:
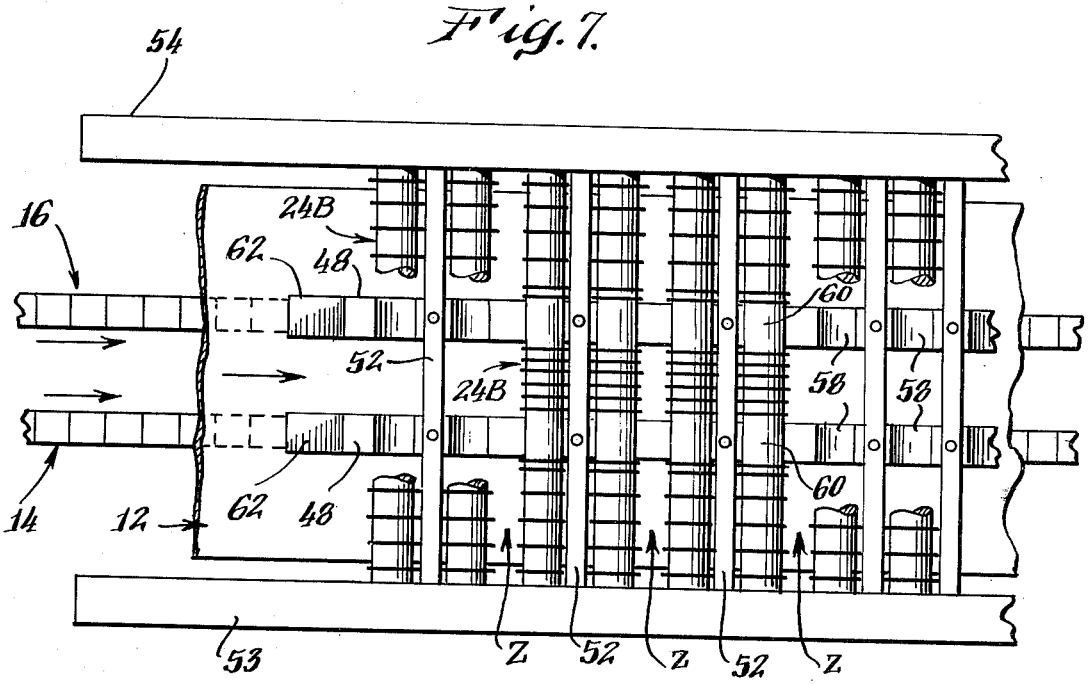
FIG. 7 is a bottom plan view of the fixed guides and finned back-up rollers.
Figure 8:
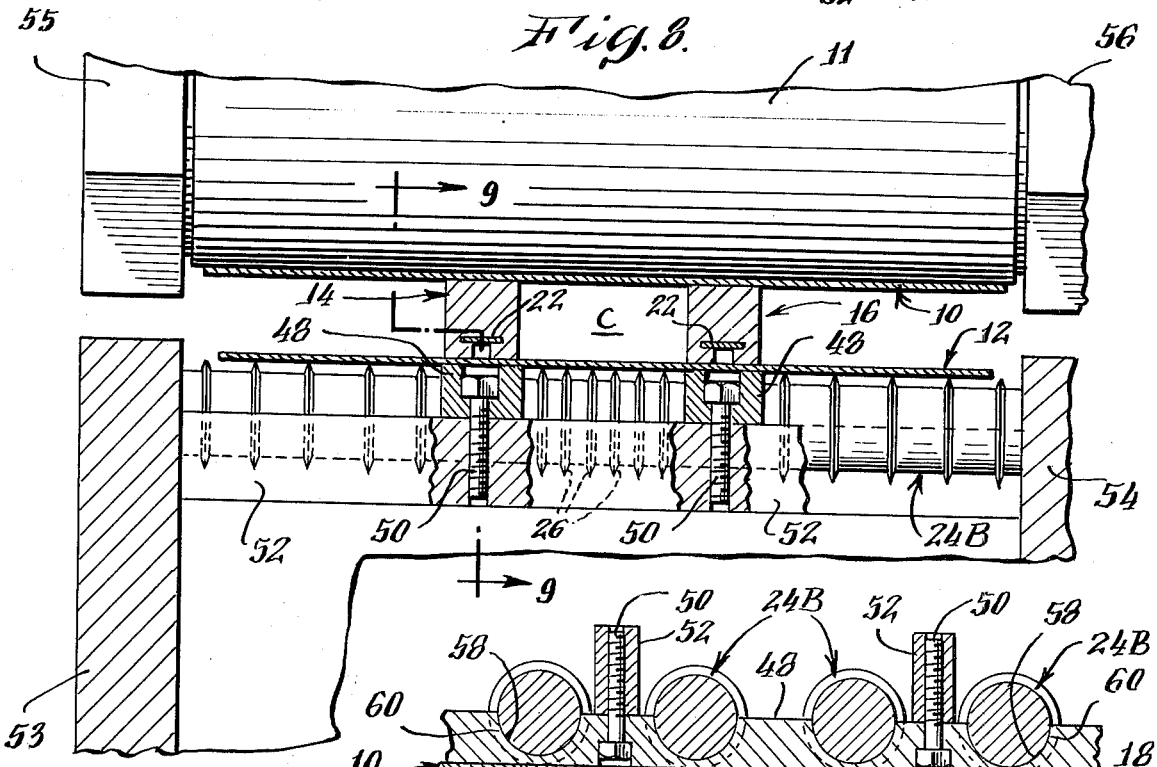
FIG. 8 is an enlarged cross-sectional view taken through the plane 8—8 in FIG. 6.

Attention is invited to FIGS. 6–9 which illustrate an alternative embodiment of the invention. Elements of the machine shown in FIGS. 6–9 performing functions corresponding with those in FIGS. 1–5 having corresponding reference numbers or letters. In FIG. 6 is shown the input end of a twin-belt casting machine. The upper and lower casting belts 10 and 12 pass around main rolls 11 and 13 and then move along in spaced, parallel, opposed relationship adjacent to the casting zone C. One of the side dams 14 is shown passing over guide rollers 44 which guide the side dam into the casting zone. The other side dam 16 (FIGS. 7 and 8) is similarly guided into the machine. A shield or protective frame member 46 may be provided near the machine input.

Figure 9:
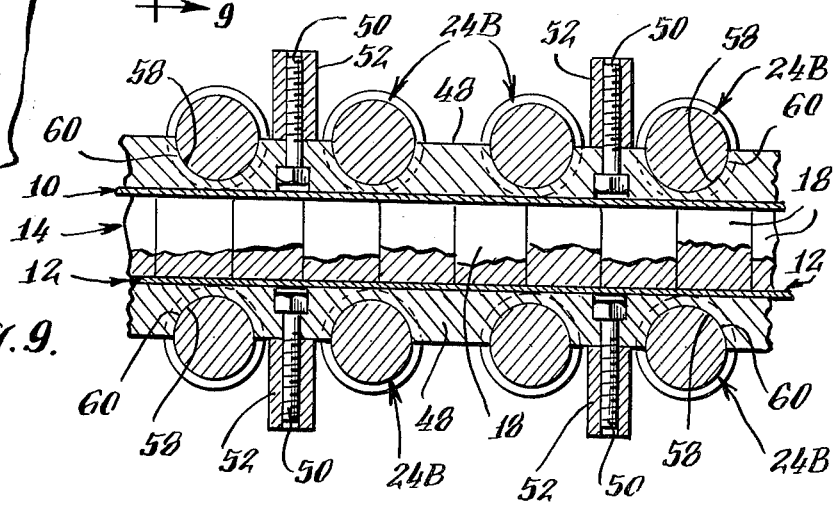
FIG. 9 is an enlargement of a portion of FIG. 6.

In order to guide and support the casting belts 10 and 12 in the side dam zone, a pair of longitudinal fixed guide members 48 are positioned adjacent to the reverse surfaces of both casting belts serving as runners along which the belts can slide. Only the pair of fixed guide members 48 for the lower belt 12 are shown for convenience of illustration in FIG. 6, and it is to be understood that there are a pair of similar guide members positioned in engagement with the reverse surface of the upper belt 10, as shown in FIG. 9. These fixed guide members 48 are spaced apart by a distance commensurate with the lateral spacing between the side dams 14 and 16. They are positioned in alignment with the respective side dams, i.e. directly opposite to the respective side dams for holding the front faces of the casting belts firmly against the damblocks of the side dams.

These fixed guide members are secured, for example by machine screws 50, to a plurality of transverse support laths or braces 52 which extend transversely between a pair of side frames 53 and 54. The ends of the back-up rollers 24B are held by bearings (not shown) mounted on the side frames 53 and 54.

It is to be noted that there are a pair of side frames 55 and 56 (FIG. 8) associated with the rollers for the upper casting belt 10. The fixed guide members (not shown) for the upper belt are supported by a plurality of similar transverse support braces (not shown) extending between these side frames 55 and 56.

In order to provide clearance for the back-up rollers 24B, the fixed guide members 48 are formed with a plurality of semicircular cylindrical recessed saddles 58, as shown most clearly in FIG. 9. The rollers 24B nest into these saddles, fins being absent from the journal portions 60 of the rollers 24B which snuggly fit into the saddles 58. In other words, the rollers 24B are similar to the roller 24A (FIG. 3) except that the collars 36 are omitted to provide the pair of journal portions 60.

The fixed guide members 48 have a relationship with respect to the side dams by an amount similar to that discussed above for the collars 36.

In the embodiment of FIGS. 6–9 the coolant application means for cooling both belts are similar to the coolant application means shown in FIG. 3. That is, nozzles are absent in the regions where the guide members 48 are located. The coolant application means have access to the reverse surfaces of the casting belts in the spaces Z between the back-up rollers 24B where the braces 52 are omitted.

The leading ends 62 (FIGS. 6 and 7) of the fixed guide members 48 may be tapered to a point with a curvature matching the radius of the main rolls 11 and 13. Thus, the leading ends of the fixed guide members will fit into the wedge-shaped space behind the main rolls 11 and 13 for supporting the belts near the main rolls to hold the belts firmly against the side dams at the input end of the machine where the molten metal is entering the casting zone.

The sliding surfaces of the fixed guide members 48 adjacent to the casting belts may be coated with a bearing metal adapted to slide against steel and to withstand the heat, for example such as bronze bearing metal. Graphite or other dry lubricant may be used on these sliding surfaces.

In summary, wide belt-supporting elements are provided engaging the reverse surfaces of the casting belt in the regions opposite the side dams. The coolant application nozzles are absent from the regions where these belt-supporting elements engage the belt. In one embodiment of the invention these wide belt-supporting elements are cylindrical collars on the back-up rollers. In another embodiment these wide belt-supporting elements are a pair of longitudinally extending fixed guide members.

I claim:

1. In a twin-belt casting machine for continuously casting molten metal wherein the molten metal is confined in a casting zone defined between the front faces of a pair of revolving flexible casting belts moving along in spaced opposed face-toward-face relationship with a pair of laterally spaced revolving side dams moving between the casting belts and each being spaced inwardly from the respective edges of the belts for defining the side edges of the casting region and wherein the reverse surfaces of the respective casting belts are supported and guided by a plurality of back-up rollers extending transversely across the full width of the casting belts and having multiple narrow fins engaging the reverse surfaces for permitting liquid coolant to travel along these reverse surfaces and in which there are coolant supply means with multiple nozzles for providing liquid coolant to travel along the reverse surfaces of the casting belt, the invention characterized by said back-up rollers each having a pair of cylindrical collars thereon said collars each being spaced inwardly from the respective ends of said rollers and engaging the reverse surfaces of the casting belts directly opposite the respective side dams, said pairs of cylindrical collars being spaced apart on the respective back-up rollers by a distance no greater than the lateral spacing between said side dams and being positioned in alignment with the respective side dams for holding the front faces of the casting belts firmly against the side dams and in which said coolant nozzles are absent from positions adjacent to and aligned with the regions where the said cylindrical collars engage the reverse surfaces of the casting belts.

2. In a twin-belt casting machine for continuously casting molten metal wherein the molten metal is confined in a casting zone defined between the front faces of a pair of revolving flexible casting belts moving along in spaced opposed face-toward-face relationship with a pair of laterally spaced side dams positioned between the casting belts defining the side edges of the casting region, said side dams each being spaced inwardly from the respective edges of the casting belts, and wherein the reverse surfaces of the respective casting belts are supported and guided by a plurality of back-up rollers extending transversely across the full width of the casting belts and each having multiple narrow fins engaging the reverse surfaces for permitting liquid coolant to travel along these reverse surfaces, the invention characterized by a plurality of wide belt-supportng elements, said elements having a lateral width at least as great as the lateral width of said side dams and engaging the reverse surfaces of the casting belts directly opposite the respective side dams for holding the front faces of the casting belts firmly against the side dams, said wide belt-supporting elements being spaced apart a distance commensurate with the spacing between said side dams, and coolant supply means with multiple nozzles for providing liquid coolant to travel along the reverse surfaces of the casting belts in which the nozzles are absent from the positions directly opposite the regions where said belt-supporting elements engage the reverse surfaces of the belts.

3. In a twin-belt casting machine for continuously casting molten metal, the invention as claimed in claim 2, in which said wide belt-supporting elements comprise a plurality of cylindrical collars on said back-up rollers, a pair of said cylindrical collars being included on each back-up roller, said collars being spaced inwardly from the respective ends of said rollers, said cylindrical collars each having an axial length at least as great as the lateral width of the associated side dam, and the axial spacing between the pair of cylindrical collars on each roller being no greater than the lateral spacing between said side dams.

4. In a twin-belt casting machine for continuously casting molten metal, the invention as claimed in claim 3, in which said back-up rollers each have a plurality of said narrow fins positioned between said cylindrical collars for engaging the reverse surface of the casting belt between said collars.

5. In a twin-belt casting machine for continuously casting molten metal wherein the molten metal is confined in a casting zone defined between the front faces of a pair of revolving flexible casting belts moving along in spaced opposed face-toward-face relationship with a pair of laterally spaced revolving side dams moving between the casting belts defining the side edges of the casting region and wherein the reverse surfaces of the respective casting belts are supported and guided by a plurality of back-up rollers extending transversely across the casting belts and having multiple narrow fins engaging the reverse surfaces for permitting liquid coolant provided by coolant supply means with multiple nozzles to travel along these reverse surfaces, the invention characterized by said back-up rollers each having a pair of cylindrical collars thereon engaging the reverse surfaces of the casting belts in the zones where the side dams are located said pairs of cylindrical collars being spaced apart on the respective back-up rollers by a distance no greater than the lateral spacing between said side dams and being positioned in alignment with the respective side dams for holding the front faces of the casting belts firmly against the side dams, each of said cylindrical collars having multiple lands thereon engaging the reverse surface of the casting belt with a peripheral groove therein between the lands for permitting coolant to travel along the reverse surface of the casting belt passing through said peripheral grooves, and said coolant nozzles are absent from the positions adjacent to and aligned with the regions where said lands engage the reverse surfaces of the casting belts.

6. In a twin-belt casting machine for continuously casting molten metal, the invention as claimed in claim 5, in which the peripheral groove is centrally located in the collar and has an axial length from 5 to 25 millimeters.

7. In a twin-belt casting machine for continuously casting molten metal, the invention as claimed in claim 5, in which one of the multiple nozzles of said coolant supply means is aimed toward the peripheral groove in each cylindrical collar.

8. In a twin-belt casting machine for continuously casting molten metal wherein the molten metal is confined in a casting zone defined between the front faces of a pair of revolving flexible casting belts moving along in spaced opposed face-toward-face relationship with a pair of laterally spaced side dams positioned between the casting belts defining the side edges of the casting region, said side dams being spaced inwardly from the respective edges of the casting belts, and wherein the reverse surfaces of the respective casting belts are supported and guided by a plurality of back-up rollers extending transversely across the casting belts and having multiple narrow fins engaging the reverse surfaces for permitting liquid coolant to travel along these reverse surfaces, the invention characterized by a plurality of wide belt-supporting elements engaging the reverse surfaces of the casting belts and being positioned opposite to the respective side dams for holding the front faces of the casting belts firmly against the side dams, said wide belt-supporting elements being spaced apart a distance commensurate with the spacing between said side dams, said wide belt-supporting elements comprising a pair of longitudinal fixed guide members engaging the reverse surfaces of the casting belts and extending parallel with the associated side dams, each of said guide members extending between the casting belt and the transverse back-up rollers, said guide members having recessed saddles therein, the back-up rollers having journal portions fitting into said recessed saddles, and coolant supply means with multiple nozzles for providing liquid coolant to travel along the reverse surfaces of the casting belts, in which the nozzles are absent adjacent the positions where said belt-supporting elements engage the reverse surfaces of the belt.

9. In a twin-belt casting machine for continuously casting molten metal, the invention as claimed in claim 8, in which said guide members are held by a plurality of transverse braces extending laterally across the casting belts between the back-up rollers.

10. In a twin-belt casting machine for continuously casting molten metal wherein the molten metal is confined in a casting zone defined between the front faces of a pair of revolving flexible casting belts moving along in spaced opposed face-toward-face relationship with a pair of laterally spaced revolving side dams moving between the casting belts and each being spaced inwardly from the respective edges of the belts for defining the side edges of the casting region and wherein the reverse surfaces of the respective casting belts are supported and guided by a plurality of back-up rollers extending transversely across the full width of the casting belts and having multiple narrow fins engaging the reverse surfaces for permitting liquid coolant to travel along these reverse surfaces, the invention characterized by said back-up rollers each having a pair of cylindrical collars thereon, said collars each being spaced inwardly from the respective ends of said rollers and engaging the reverse surfaces of the casting belts directly opposite the respective side dams, said pairs of cylindrical collars being spaced apart on the respective back-up rollers by a distanct no greater than the lateral spacing between said side dams and being positioned in alignment with the respective side dams for holding the front faces of the casting belts firmly against the side dams and in which each of said cylindrical collars has an axial length at least as great as the lateral width of said side dams.

11. In a twin-belt casting machine for continuously casting molten metal, the invention as claimed in claim 10, in which the axial length of said cylindrical collars is somewhat greater than the lateral width of said side dams, and the spacing between said cylindrical collars is less than the spacing between said side dams by an amount up to approximately 30 millimeters for a casting region up to 120 millimeters in width.

* * * * *